US008112928B2

(12) United States Patent
Keough

(10) Patent No.: US 8,112,928 B2
(45) Date of Patent: Feb. 14, 2012

(54) TRIGGER-CONTROLLED SELECT FIRE FOR M-16 RIFLE

(76) Inventor: Ronald William Keough, Aubern, ME (US)

( * ) Notice: Subject to any disclaimer, the term of this patent is extended or adjusted under 35 U.S.C. 154(b) by 202 days.

(21) Appl. No.: 12/412,863

(22) Filed: Mar. 27, 2009

(65) Prior Publication Data

US 2011/0315002 A1 Dec. 29, 2011

Related U.S. Application Data

(60) Provisional application No. 61/113,731, filed on Nov. 12, 2008.

(51) Int. Cl.
*F41A 19/46* (2006.01)

(52) U.S. Cl. ..... 42/69.03; 89/128; 89/132; 89/140

(58) Field of Classification Search ..... 42/69.01–69.03; 89/128, 129.01, 132, 140
See application file for complete search history.

(56) References Cited

U.S. PATENT DOCUMENTS 5,501,134 A * 3/1996 Milazzo et al. ..... 89/139
6,131,324 A * 10/2000 Jewell ..... 42/69.03
6,615,527 B1 * 9/2003 Martin ..... 42/69.03
7,421,937 B1 * 9/2008 Gangl ..... 89/142
7,654,187 B2 * 2/2010 Hochstrate et al. ..... 89/142
2004/0020094 A1 * 2/2004 Ealovega ..... 42/69.03
2007/0051236 A1 * 3/2007 Groves et al. ..... 89/142
2010/0281739 A1 * 11/2010 Geissele ..... 42/69.01

OTHER PUBLICATIONS

SWD Lightning Link (www.quarterbore.com/nfa/lightninglink.html).*

* cited by examiner

*Primary Examiner* — Bret Hayes
*Assistant Examiner* — Joshua Freeman
(74) *Attorney, Agent, or Firm* — Donald R. Boys; Central Coast Patent Agency, Inc.

(57) ABSTRACT

A trigger system for a firearm has an enclosure having a bottom surface, a trigger pivoted at a first pivot axis within the enclosure, a firing hammer pivoted at a second pivot axis within the enclosure, the firing hammer spring-loaded to rotate clockwise to fire, the firing hammer having a first notch, a disconnector pivoted at the first pivot axis, the disconnector rocker having a hook for engaging the first notch in the firing hammer preventing firing while engaged, and a full auto rocker pivoted at a third pivot axis through the trigger, the full auto rocker having a first portion extending downward and forward from the third pivot axis and a second portion extending rearward from the third pivot axis, a part of the second portion overlying a contact point on the disconnector to the rear of the first pivot axis.

14 Claims, 5 Drawing Sheets

TRIGGER-CONTROLLED SELECT FIRE FOR M-16 RIFLE

CROSS-REFERENCE TO RELATED APPLICATIONS

The present invention claims priority to a U.S. provisional patent application Ser. No. 61/113,731 entitled TRIGGER-CONTROLLED SELECT FIRE FOR AN M-16 RIFLE filed on Nov. 12, 2008, disclosure of which is incorporated herein at least by reference.

BACKGROUND OF THE INVENTION

1. Field of the Invention

The present invention is in the field of firearms and pertains particularly to methods and apparatus for enabling a trigger mechanism to switch firing modes from semi-automatic to full automatic under variable applied pressure to the trigger component of the mechanism, the pressure resulting in a change in position of the trigger.

2. Discussion of the State of the Art

In the field of firearms there are rifles manufactured for military use. A good example of such a rifle is an M-16 rifle. The M-16 rifle is a military weapon that typically has three firing modes governed by a safety selector, the three modes including a safety mode, a semi-automatic mode, and a fully automatic mode. The safety selector mechanism built into the wall of the lower receiver unit and integral to the trigger system is set manually by an operator of the weapon.

In safety mode the rifle will not fire. In semi-automatic mode a hammer is released and strikes a firing pin when a user pulls the trigger. Expanding gas from the barrel drives a retraction bolt backward against a spring, resulting in ejection of the spent shell casing and loading of a new shell. The retraction bolt causes the hammer to rotate back into trigger position where it is automatically latched by the disconnector until the trigger returns to full forward, so a second shot cannot be fired while the trigger is still being pulled. When the trigger returns forward the disconnector is released and the hammer rests on the forward end of the trigger. A notch provided in the hammer seats against the trigger and the disconnector moves back and is no longer latching the hammer. The trigger mechanism is then ready to release the hammer to fire a next shot. It has occurred to the inventor that switching from semi-automatic to fully automatic mode for an M-16 and like rifles need not be solely a manual process. Therefore, what is clearly needed is a pressure activated trigger mechanism that enables mode selection between semi-auto and full auto through the application of pressure on the trigger, changing position of the trigger.

SUMMARY OF THE INVENTION

A problem stated above is that while it is desired to be able to fire continuously using automatic fire on a military weapon, conventional means for selecting automatic fire requires adjustment of a safety selector switch on the rifle.

Therefore the inventor searched components of trigger systems looking for components that exhibit potential to be modified to enable variable modes of firing without changing firing settings.

It occurred to the inventor during an inventive moment that if continuous automatic fire could be enabled in a military rifle without manually setting the mode of fire, then the weapon could be fired more efficiently.

Therefore, the inventor created a full auto rocker mechanism and integrated the mechanism with a conventional trigger system creating a unique trigger system, the rocker mechanism enabling full continuous automatic firing of the weapon while the weapon is set in semiautomatic firing mode via the safety selector.

Accordingly, in one embodiment of the present invention a trigger system for a firearm including an enclosure having a bottom surface, a trigger pivoted at a first pivot axis within the enclosure, the trigger having a finger extension through the enclosure bottom surface, such that a user may rotate the trigger rocker clockwise around the first pivot axis by pressure on the finger extension, a firing hammer pivoted at a second pivot axis within the receiver volume, forward from the first pivot axis, the firing hammer spring-loaded to rotate clockwise to fire, the firing hammer having a first notch, a disconnector pivoted at the first pivot axis, the disconnector rocker having a hook for engaging the first notch in the firing hammer, which when engaged prevents the firing hammer from rotating clockwise to fire, and a full auto rocker pivoted at a third pivot axis through the trigger, the full auto rocker having a first portion extending downward and forward from the third pivot axis and a second portion extending rearward from the third pivot axis, a part of the second portion overlying a contact point on the disconnector to the rear of the first pivot axis.

With a safety selector positioned in semiautomatic fire mode, rotation of the trigger clockwise to a first position, through a first angle, causes the forward, downward extending portion of the full auto rocker to contact the bottom surface of the enclosure, and further clockwise rotation of the trigger rocker beyond the first position causes the full auto rocker to rotate counterclockwise about the third pivot axis, which causes the rearward portion of the full auto rocker to urge downward on the disconnector rocker at the contact point, rotating the disconnector rocker also counterclockwise, leaving the firing hammer unrestrained to fire repeatedly in full automatic mode.

In one embodiment the trigger comprises a front edge engaging a second notch in the firing hammer with the firing hammer fully cocked counterclockwise, and the finger extension of the trigger fully forward, thereby holding the firing hammer fully cocked. In one embodiment the trigger system further comprises a safety selector having three selectable positions one of safety, preventing the firing hammer from rotating to fire, semiautomatic, allowing the weapon to fire in that mode and in select fire full automatic depending on variable trigger position, and full automatic mode allowing the weapon to be fired only in that mode.

In a preferred embodiment the third pivot axis through the trigger and the full auto rocker is a pin provided through an opening provided in the trigger and openings in the rocker. In one embodiment the safety selector is modified through provision of a relief slot to prevent obstruction of full automatic firing while the safety is set in semiautomatic mode. In a preferred embodiment the rocker is forced into a counterclockwise rotation about the coupling when added pressure is applied to the trigger due to the position of and cam shape of the rocker ends.

In one embodiment the trigger system is installed in the lower receiver of an M-16 or AR-15 rifle.

According to another aspect of the invention a full auto rocker is provided integrated to a trigger system, the full auto rocker comprising a pair of rocker arms of a like profile and length bridged by a wall at one end and extending away from the wall in substantially parallel alignment, the rocker arms sloping downward and culminating at open cam-shaped ends, and a pair of openings placed horizontally through the rocker arms at a location proximal to the cam-shaped ends. The openings provide a pin path for coupling the rocker mechanism to a trigger of the trigger system forming a pivot point for the full auto rocker, the trigger modified with an opening for accepting a pin.

In one embodiment the trigger is pinned between the rocker arms and the full auto rocker is fabricated from stainless steel. In a preferred embodiment, the cam-shaped ends make contact with a bottom surface of a trigger compartment housing the trigger system when a trigger of the trigger system is pulled past a semiautomatic firing position.

In the above embodiment the applied force to the trigger beyond the initial contact made urges the rocker mechanism to rotate counter clockwise about the pivot point the direction of rotation directed by the cam shape of the ends of the rocker arms. Further to this embodiment, the forced rotation causes the bridged end of the rocker mechanism to make contact with a disconnector of the trigger system preventing it from engaging a hammer of the trigger system.

According to another aspect of the present invention a method is provided for controlling the transition from semiautomatic fire to full automatic fire and back to semiautomatic fire in a trigger system enhanced with a full auto rocker, the trigger system set to semiautomatic firing mode via a safety selector integral to the trigger system comprising the steps (a) pulling a trigger of the trigger system to a first position through a first angle until a single shot is fired in semiautomatic mode, (b) pulling the trigger further toward a second position through a second angle causing the full auto rocker to make contact with a bottom surface of the trigger enclosure and to rotate counterclockwise about a pivot point, (c) pulling the trigger further toward the second position until the full auto rocker makes contact with a disconnector causing it to disengage from the hammer initiating full automatic firing, (d) releasing the trigger to engage the disconnector to the hammer stopping full automatic firing, and (e) releasing the trigger to the maximally forward position to latch the hammer to the trigger allowing the disconnector to disengage from the hammer.

In a preferred aspect of the method the safety selector is slotted for part relief. In one aspect in step (a) the hammer of the trigger system is released by the trigger of the trigger system to fire the single shot. In this aspect in step (b) the disconnector is engaged to the hammer. In a preferred aspect in step (c) the hammer remains unrestrained as long as the position of the trigger is maintained.

In one aspect of the method in step (d) full auto firing may be re-initiated without releasing the trigger to the forward position by again pulling the trigger toward the second position until the disconnector is again disengaged from the hammer. In one aspect in step (e) the safety selector may be moved to safety or full automatic fire.

BRIEF DESCRIPTION OF THE DRAWING FIGURES

DETAILED DESCRIPTION

The inventors provide a trigger system for a military rifle, such as an M-16 or AR-15 for example, that is adapted to be switched from semiautomatic fire to full automatic fire without manually changing position of a safety selector. The invention is described in enabling detail in the following examples, which may represent more than one embodiment of the invention.

Figure 1:
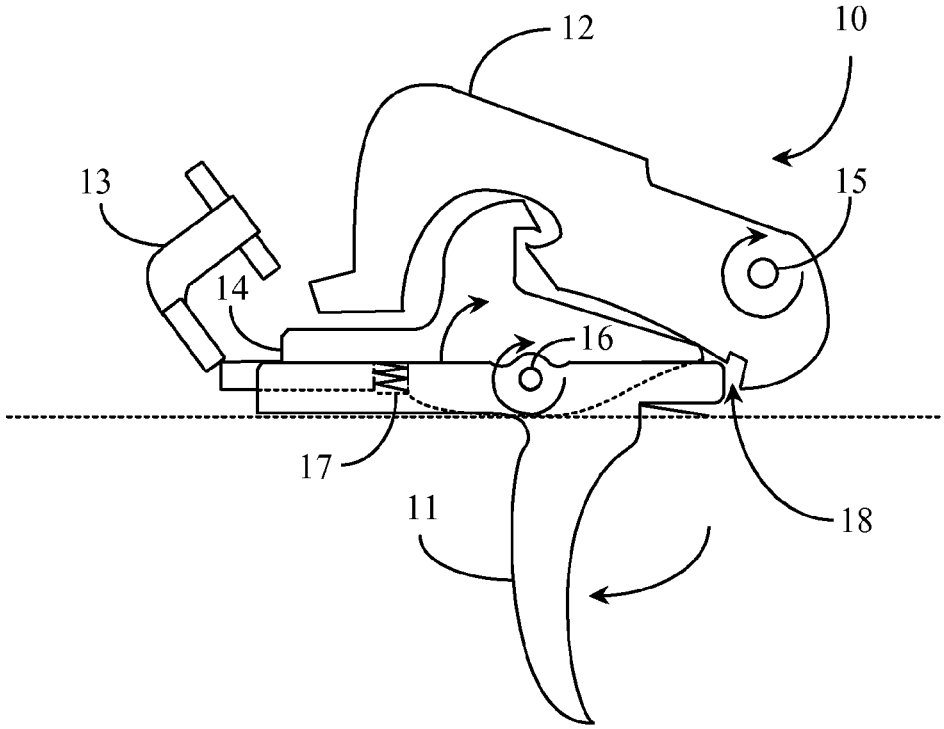
Fig. 1 (Prior Art)
FIG. 1 is an elevation view of a trigger system for an M-16 according to current art.

FIG. 1 is an elevation view of a trigger system 10 for an M-16 according to current art. Trigger system 10 is a grouping of components that together form a trigger mechanism for a standard issue M-16 or an AR-15 style military rifle. As described further above the trigger system is adapted to be controlled by a safety selector, which enables two modes of fire, semiautomatic and automatic, sometimes referred to as select fire in the art.

Trigger system 10 includes a trigger 11 and a disconnector 14. Trigger 11 and disconnector 14 are pivotally mounted on a common axis in a trigger compartment of the lower receiver (not illustrated). One with skill in the art of military weapons will recognize the term lower receiver as the detachable lower stock portion of the weapon containing the trigger system.

Trigger 11 and disconnector 14 are pivotally mounted at a pivot axis 16. Trigger 11 is spring-loaded to assume a first forward position where no firing can occur. The safety selector (not illustrated here) enables the trigger to be locked in the forward or safety position. In this position the weapon cannot be fired. Disconnector 14 is spring-loaded clockwise from the trigger via a coil spring 17. Hammer 12 is illustrated in this example and is pivotally mounted at a pivot point 15. Hammer 12 is spring-loaded to pivot in the clockwise direction of the circular arrow associated with pivot point 15. A full auto sear 13 is illustrated in this example and enables full automatic fire when the safety selector is set in full auto position only. Other springs, pins, retainers, and like hardware known in a trigger system are not illustrated in this example but may be assumed present where required.

In conventional operation as known to persons skilled in the art, when the trigger is maximally forward, hammer 12 is prevented from pivoting about pivot point 15 by a notch 18 that rests on the forward end of trigger 11. At this position disconnector 14 is not latching hammer 12. To fire, the movement of trigger 11 (pull back) from the forward position releases hammer 12 to pivot clockwise thus firing a single shot (semiautomatic mode).

The retraction bolt (not illustrated) forces the hammer to pivot back around to a position where disconnector 14 latches it until the trigger is released and moves back to forward position. Disconnector 14 is urged forward when the trigger is pulled according to the clockwise direction of the arrow associated with pivot point 16. Therefore, disconnector 14 is in a position to catch the recoiling hammer after the shot is fired and before the trigger is released to prepare for a next shot.

Figure 2:
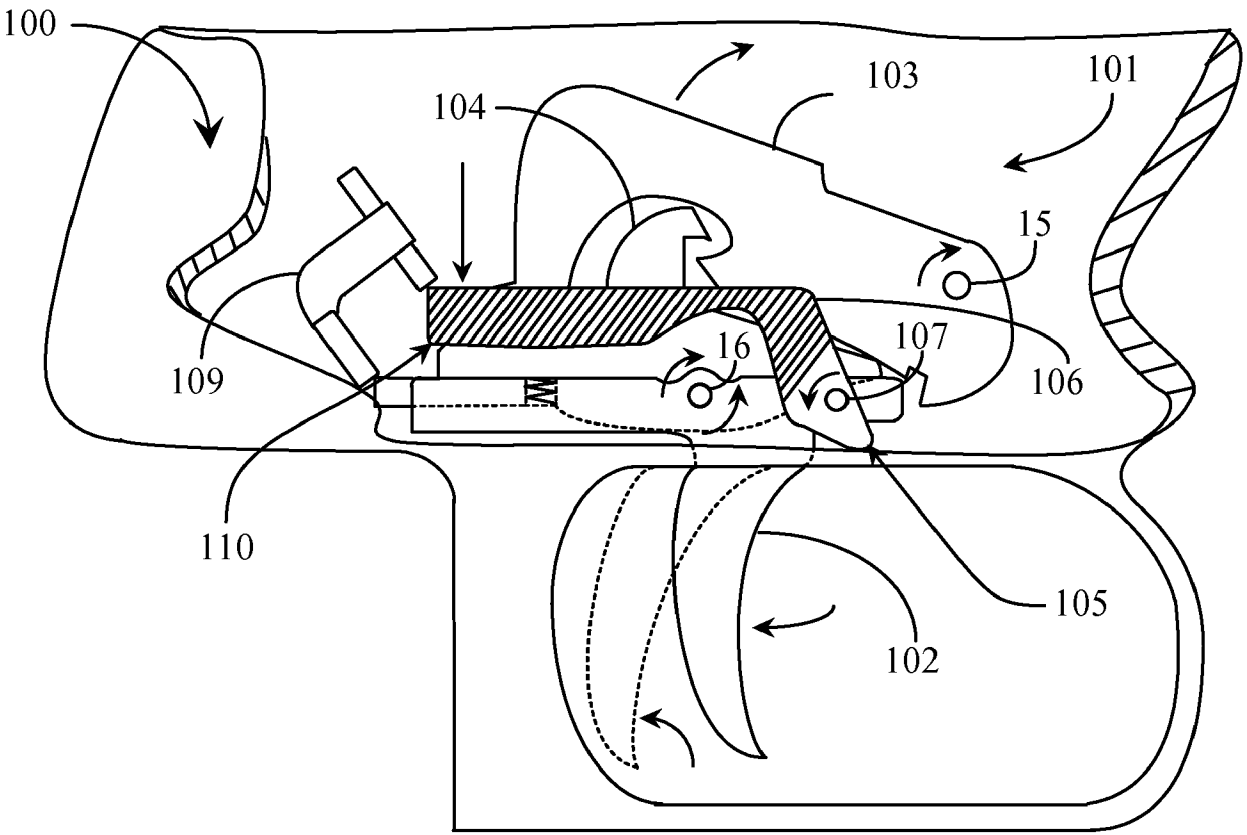
FIG. 2 is an elevation view of an M-16 trigger compartment 100 with a portion thereof broken away to expose a trigger system 101 according to an embodiment of the present invention.

FIG. 2 is an elevation view of an M-16 trigger compartment 100 with a portion thereof broken away to expose a trigger system 101 according to an embodiment of the present invention. Trigger compartment 100 is a standard receiver for housing a trigger system and other related mechanical components of a rifle. A portion of trigger compartment 100 is broken away to expose trigger system 101 illustrating the basic trigger components used to fire the rifle.

Trigger system 101 is illustrated in this example and is assembled in character of a standard M-16 rifle. The example of an M-16 is used here but it should be noted that the application of the invention is not limited to a specific rifle or trigger system.

Trigger system 101 includes a trigger 102 accessible to an operator through a trigger well in the lower receiver. Trigger 102 is typically manufactured of a durable metal like steel and retains the machined shape of a conventional trigger. A conventional trigger may be used with a slight modification of the trigger by placing an opening 107 through the trigger body at a strategic location forward of the standard pivot point 107 shared by the trigger and disconnector 104 of the trigger. Disconnector 104 is analogous to disconnector 14 described above and is not necessarily modified in order to practice the present invention.

Trigger system 101 includes a hammer 103. Hammer 103 may be a conventional steel hammer including the contouring and notching required for normal hammer operation within the trigger system. Hammer 103 is analogous to hammer 12 of FIG. 1 and does not necessarily require modification in order to practice the present invention. Trigger system 101 includes disconnector 104 that is partially visible in this example. Disconnector 104 is a conventional disconnector for latching and releasing the hammer as described further above. When trigger 102 is in the full forward position (not being pulled) the disconnector has no contact with the hammer. The trigger prevents the hammer from releasing at this point.

In some embodiments a safety selector (not illustrated here) may be mounted through the wall of the trigger well in the vicinity of the trigger system. More about the safety selector and how it may be modified to practice the invention is provided further below. A standard full auto sear 109 is illustrated within trigger system 101 and is adapted to enable full automatic firing with the safety selector set to full auto mode. Full auto sear 109 is analogous to full auto sear 13 described further above and does not require modification in order to practice the present invention.

Trigger system 101 may be assumed to include all of the necessary mounting hardware, springs, and pins required and known in the art enabling the assembly to perform within the lower receiver. Trigger system 101 further includes a novel component termed a full auto rocker by the inventor, and illustrated herein as a full auto rocker 106. Full auto rocker 106 is illustrated in trigger system 101 in section line to visually separate it more clearly from the other components. Full auto rocker 106 is illustrated in elevation within trigger system 101 and is pivotally mounted to trigger 102 at pivot axis 107 to form a pivot point for the full auto rocker.

It is not visible in elevation view, however full auto rocker 106 has two sides separated by a bridge element that overlies a portion of the disconnector. Full auto rocker 106 is therefore mounted at axis 107 on both sides of the trigger. It is noted herein that the full auto rocker is mounted to the trigger, so the pivot axis only applies only to the full auto rocker. In a preferred embodiment full auto rocker 106 is fabricated of durable steel. In some embodiments the full auto rocker is spring-loaded clockwise.

Without full auto rocker 106, firing is accomplished in the standard manner. With the safety on, the trigger is locked in forward position and no firing is possible. With the safety switched to semi-automatic firing mode, trigger 102 may be pulled back to fire one shot at a time. The trigger must be pulled back and then released before a next shot can occur each time a shot is fired in semi-auto mode. The safety selector must be switched to full auto firing mode before automatic fire can occur by pulling the trigger and maintaining the trigger position to continue firing.

In embodiments of the present invention full auto rocker 106 enables full automatic fire while the rifle is in semiautomatic firing mode as dictated by the safety selector. The full auto rocker is an elongate piece a shown having two sides with identical cam-shaped ends disposed at a downward angle. At one point in trigger movement, since the full auto rocker is pivoted to the trigger forward of the trigger pivot axis, the cam ends of the full auto rocker will strike the bottom of the receiver well at point 105. Moving the trigger past this position forces the cam-shaped rocker ends of full auto rocker downward against the bottom surface of the trigger system compartment above the trigger well, and causes the full auto rocker to rotate counterclockwise about axis 107.

The contact and subsequent force applied, causing counterclockwise rotation of the full auto rocker urges the bridge end of full auto rocker 106 down against disconnector 104 at a contact point 110. The contact forces the disconnector back against a coil spring between the disconnector and the trigger, preventing the disconnector from moving forward as the trigger is further pulled, so it (the disconnector) may no longer latch the hammer. In this way the full auto rocker enables full automatic fire via standard auto sear 109 as long as the trigger position is maintained.

A relief slot is provided to the engaging surface of the safety selector (not illustrated here) to enable part clearance of the engaging portion of the selector while the selector is left in semiautomatic firing position. To return to semiautomatic firing the operator simply releases pressure against trigger 102, allowing the trigger to return full auto rocker 106 to its original position in the assembly. Disconnector 104 may then move forward (clockwise rotation) to catch and latch hammer 103 until the trigger is again at the maximally forward position where the hammer rests against the forward end of the trigger prior to a next shot fired in semiautomatic mode.

Figure 3:
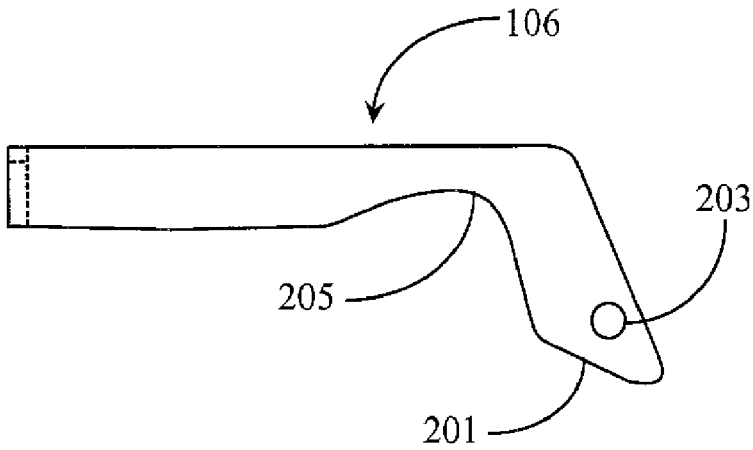
FIG. 3 is an elevation view of the full auto rocker of FIG. 1 according to an embodiment of the present invention.
Figure 4:
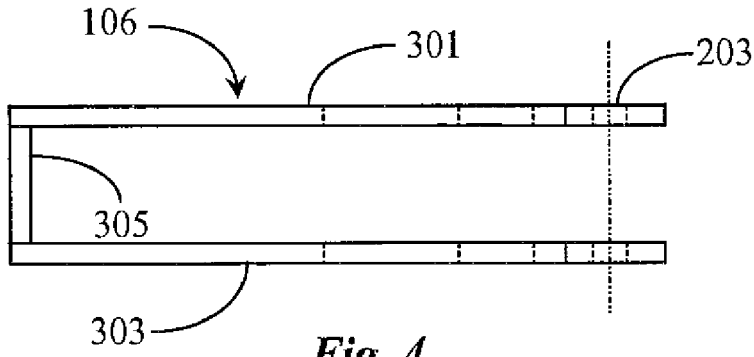
FIG. 4 is an overhead view of the full auto rocker of FIG. 2.
Figure 5:
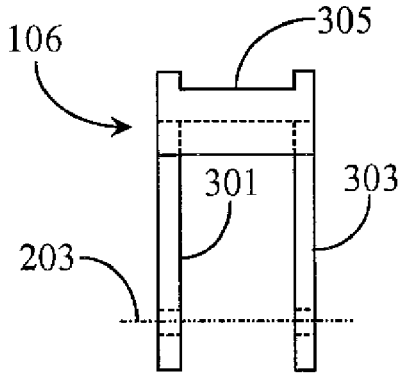
FIG. 5 is an end view of the full auto rocker of FIG. 2.

FIGS. 3, 4 and 5 are different views of full auto rocker 106 of FIG. 2 according to an embodiment of the present invention. Full auto rocker 106 includes an opening 203 placed inline through both rocker ends corresponding with the opening 107 in trigger 102 of FIG. 1. Opening 203 provides a passage for a pin (not illustrated) that passes through openings 203 and trigger opening 107. The openings (203) may be drilled and then reamed to a tight tolerance and in true position relative to the cam-shaped ends of full auto rocker 106 so that the position of the auto rocker in the assembly is substantially parallel to the floor of the trigger system compartment. The pin (not illustrated) may be manufactured to an outside diameter (OD) just smaller than openings 203 to provide a snug slip fit. In this way, both ends make contact with the floor simultaneously and pressure is distributed equally over the auto rocker arm to the disconnector.

Full auto rocker 106 has a relief radius 205 provided at a strategic location in each auto rocker arm at a position where the elongate body portion of the rocker meets the cam-shaped end of the rocker. The relief radii are provided so that full auto rocker 106 does not contact any other components in the trigger system besides disconnector 104.

FIG. 4 is a plan view of full auto rocker 106 of FIG. 2. Full auto rocker 106 in plan view exhibits a symmetrical profile. An auto rocker arm 301 and an auto rocker arm 303 are held substantially parallel and apart by a rear bridge element 305. Openings 203 are inline with one another, full auto rocker 106 may be machined from a piece of stainless steel or other durable metal. The overall length of full auto rocker 106 is held such that wall 305 makes contact at contact point 110 with the back surface of disconnector 104.

FIG. 5 is an end view of full auto rocker 106 of FIG. 2. Viewed from the left end of full auto rocker 106 of FIG. 2, arms 301 and 303 and back wall 305 are visible. Full auto rocker 106 is pinned at openings 203 to the trigger in the trigger system at an opening provided through the trigger to accommodate the pin. The gap distance between the inside of arm 301 and the inside of arm 303 is sufficiently wide to enable full auto rocker 106 to fit over the trigger accommodating the disconnector and the hammer within the gap.

Figure 6:
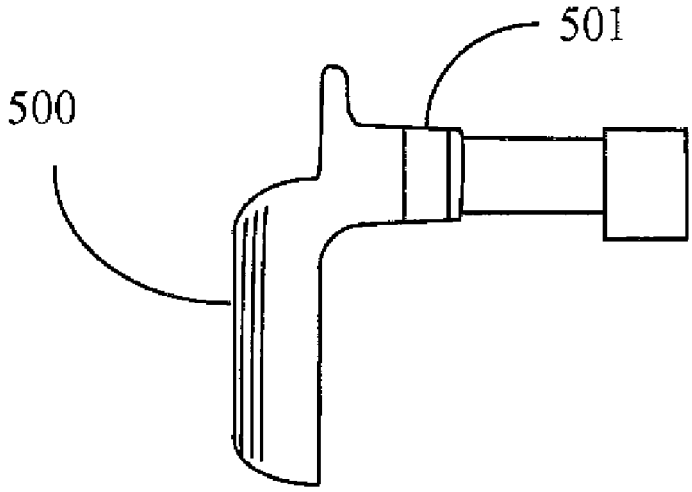
FIG. 6 is an elevation view of a safety selector switch modified to practice the invention.

FIG. 6 is an elevation view of a safety selector switch 500 modified to practice the invention. Safety selector switch 500 is a standard selector switch that is modified to practice the invention by provision of a relief slot 501 placed into the portion of the selector that contacts the disconnector and full auto sear unit 109 described further above in FIG. 1. The relief enables the selector to remain in semi automatic mode with the full auto sear (109) engaged and the disconnector (104) disengaged from the hammer.

Figure 7:
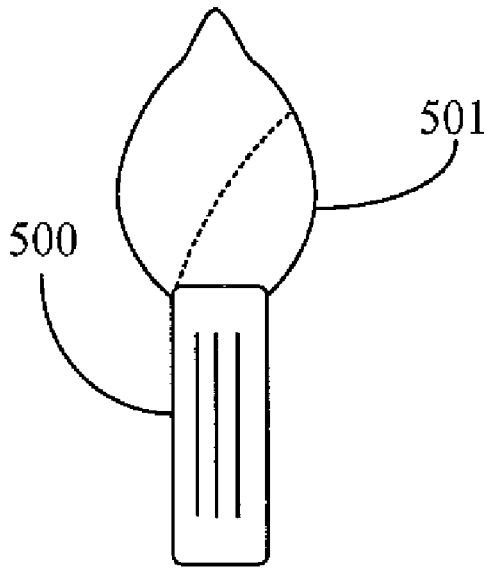
FIG. 7 is a left-end view of the safety selector of FIG. 5.

FIG. 7 is a left-end view of safety selector 500 of FIG. 5. Viewed from the end, selector 500 is shown as it would be presented to an operator on the face of the trigger compartment unit housing the trigger system. Relief slot 501 is presented at a slight angle and is sufficiently deep to provide the required relief.

Safety selector 500 and trigger 102 are the only standard parts of trigger system (101) that have to be modified in order to accommodate full auto rocker 106 into the trigger system as a functioning component.

Figure 8:
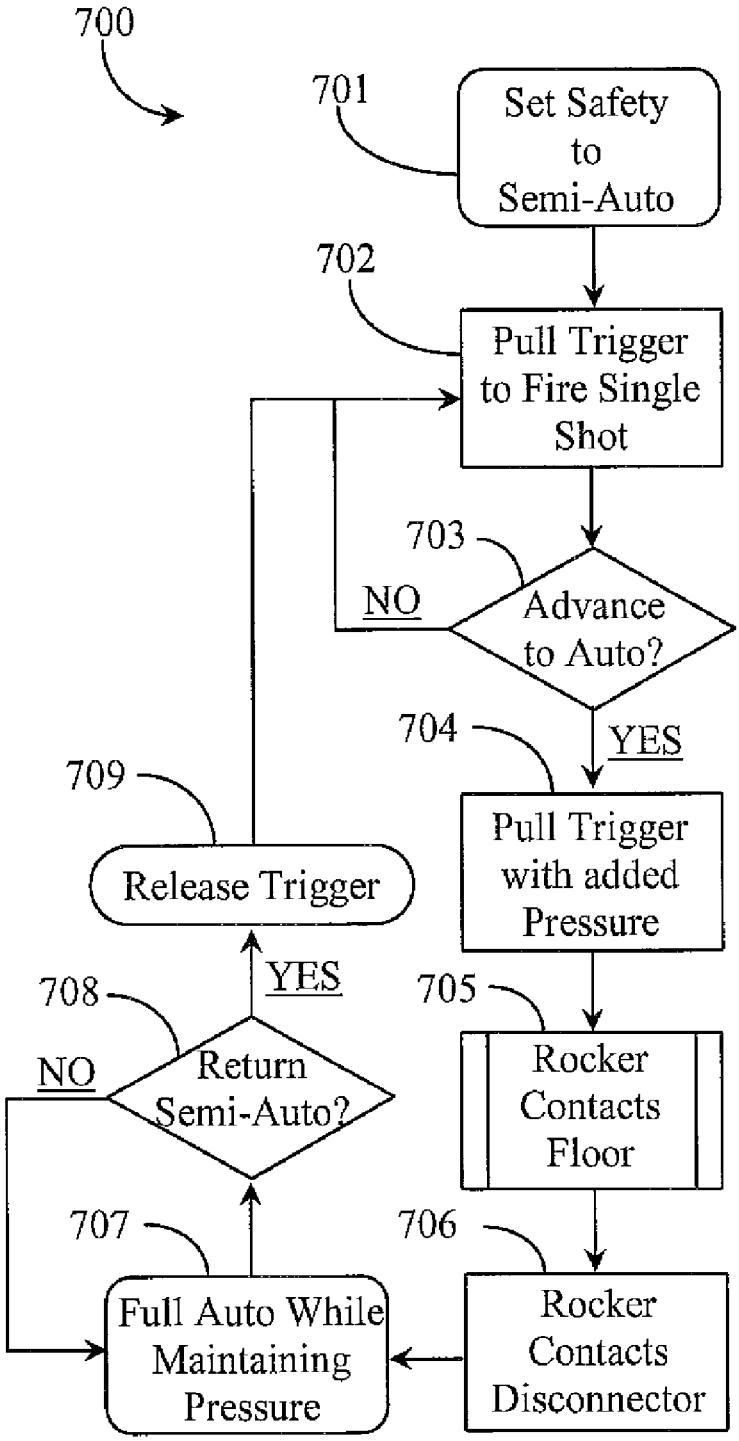
FIG. 8 is a process flow chart illustrating steps 700 for practicing full automatic fire from semi-automatic mode according to an embodiment of the present invention.

FIG. 8 is a process flow chart illustrating steps 700 for practicing full automatic fire from semi-automatic mode according to an embodiment of the present invention. An operator of the rifle sets the safety selector to semi-automatic mode at step 701. This setting enables single shot semiautomatic firing by pulling and releasing the trigger. The operator pulls the trigger while in semiautomatic firing mode to fire a single shot in that mode at step 702. The operator may make a decision at step 703 whether to advance to automatic firing while remaining in a semiautomatic firing mode.

If at step 703 the operator determines not to engage automatic firing then the process loops back to step 702 where the operator continues to fire in semiautomatic mode by pulling on the trigger to fire a shot then releasing the trigger to prepare for the next shot. If at step 703 the operator decides to engage in automatic firing while the safety selector is set to semiautomatic firing mode, then at step 704 the operator pulls the trigger back with added pressure and does not release the trigger. The operator may develop a feel for the variable amount of pressure required to engage automatic fire in semiautomatic firing mode.

The full auto rocker makes contact with the floor of the trigger system compartment at step 705 as the trigger is pulled further back. The rocker arm ends forced against the floor cause the full auto rocker to rotate counterclockwise about the pin connecting the rocker to the trigger. The forced rotation causes the full auto rocker to press down on the disconnector at step 706 releasing the disconnector from the hammer.

The operator maintains full automatic firing at step 707 while maintaining the pressure applied to the trigger. The auto sear unit operates normally and the slot relief provided in the safety selector prevents it from moving out of semiautomatic mode. At step 708 the operator may decide whether to return to semiautomatic firing or not.

If the operator decides not to return to semiautomatic firing, the process loops back to step 707 and full pressure is maintained on the trigger to continue automatic fire. If the operator chooses to return to semiautomatic firing then at step 709 the operator releases the trigger causing the disconnector to engage the hammer and the hammer to engage the forward end of the trigger enabling the disconnector to disengage from the hammer. Semiautomatic firing is resumed as the process loops back to step 702.

With the full auto rocker (106) of the invention, the operator may in semiautomatic firing mode, switch from semiautomatic firing to automatic firing and back at will by varying the pressure applied to the trigger component. The operator is not required to switch the safety selector to automatic firing mode.

The full auto rocker of the present invention is illustrated in a trigger system that is typical of an M-16 military rifle. However, invention is not limited to an M-16 rifle. The auto rocker may be installed in a trigger system belonging to an AR-15 military rifle and other similar weapons without departing from the spirit and scope of the present invention. Adapting the auto rocker to other trigger systems may require somewhat different modifications of the integral components of the trigger system. For example, the location of the opening provided in the trigger may be different and there may be differences in slot relief for the safety selector without departing from the spirit and scope of the present invention.

It will be apparent to one with skill in the art that the full auto rocker system of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

What is claimed is:

1. A trigger system for a firearm, comprising:

an enclosure having a bottom surface;

a trigger pivoted at a first pivot axis within the enclosure, the trigger having a finger extension through the enclosure bottom surface, such that a user may rotate the trigger clockwise around the first pivot axis by pressure on the finger extension;

a firing hammer pivoted at a second pivot axis within the enclosure, forward from the first pivot axis, the firing hammer spring-loaded to rotate clockwise to fire, the firing hammer having a first notch;

a disconnector pivoted at the first pivot axis, the disconnector having a hook for engaging the first notch in the firing hammer, which when engaged prevents the firing hammer from rotating clockwise to fire; and a full auto rocker pivoted at a third pivot axis through the trigger between the first and the second pivot axes, the full auto rocker having a first portion extending downward and forward from the third pivot axis and a second portion extending rearward from the third pivot axis, a part of the second portion overlying a contact point on the disconnector to the rear of the first pivot axis;

wherein with a safety selector positioned in semiautomatic fire mode, rotation of the trigger clockwise to a first position, through a first angle, causes the first portion of the full auto rocker to contact the bottom surface of the enclosure, and further clockwise rotation of the trigger beyond the first position causes the full auto rocker to rotate counterclockwise about the third pivot axis, which causes the second portion of the full auto rocker to urge downward on the disconnector at the contact point, rotating the disconnector also counterclockwise, leaving the firing hammer unrestrained to fire repeatedly in full automatic mode.

2. The trigger system of claim 1 wherein the trigger comprises a front edge engaging a second notch in the firing hammer with the firing hammer fully cocked counterclockwise, and the finger extension of the trigger fully forward, thereby holding the firing hammer fully cocked.

3. The trigger system of claim 1 wherein the safety selector having three selectable positions one of safety, preventing the firing hammer from rotating to fire, semiautomatic, allowing the weapon to fire in that mode and in select fire full automatic depending on variable trigger position, and full automatic mode allowing the weapon to be fired only in that mode.

4. The trigger system of claim 1 wherein the third pivot axis through the trigger and the full auto rocker is a pin provided through an opening provided in the trigger and openings in the rocker.

5. The trigger system of claim 1 wherein the safety selector is modified through provision of a relief slot to prevent obstruction of full automatic firing while the safety selector is set in semiautomatic mode.

6. The trigger system of claim 1 wherein the full auto rocker is forced into a counterclockwise rotation about the third pivot axis when added pressure is applied to the trigger due to the position of and cam shape of the first portion.

7. The trigger system of claim 1 installed in the lower receiver of an M-16 or AR-15 rifle.

8. A method for controlling transition from semiautomatic fire to full automatic fire and back to semiautomatic fire in a trigger system enhanced with a full auto rocker, the trigger system set to semiautomatic firing mode via a safety selector integral to the trigger system comprising the steps:

(a) pulling a trigger of the trigger system to a first position through a first angle until a single shot is fired in semiautomatic mode;

(b) pulling the trigger further toward a second position through a second angle causing the full auto rocker to make contact with a bottom surface of the trigger enclosure and to rotate counterclockwise about a pivot point;

(c) pulling the trigger further toward the second position until the full auto rocker makes contact with a disconnector causing it to disengage from a hammer initiating full automatic firing;

(d) releasing the trigger to engage the disconnector to the hammer stopping full automatic firing; and (e) releasing the trigger to the maximally forward position to latch the hammer to the trigger allowing the disconnector to disengage from the hammer.

9. The method of claim 8 wherein in the safety selector is slotted for part relief.

10. The method of claim 8 wherein in step (a) the hammer of the trigger system is released by the trigger of the trigger system to fire the single shot.

11. The method of claim 8 wherein in step (b) the disconnector is engaged to the hammer.

12. The method of claim 8 wherein in step (c) the hammer remains unrestrained as long as the position of the trigger is maintained.

13. The method of claim 8 wherein in step (d) full auto firing may be re-initiated without releasing the trigger to the forward position by again pulling the trigger toward the second position until the disconnector is again disengaged from the hammer.

14. The method of claim 8 wherein in step (e) the safety selector may be moved to safety or full automatic fire.

* * * * *